US005470223A

United States Patent [19]

McCoy

[11] Patent Number: 5,470,223

[45] Date of Patent: Nov. 28, 1995

[54] MICROPROCESSOR CONTROLLED FUEL AND IGNITION CONTROL FOR A FUEL BURNING DEVICE

[75] Inventor: Hugh W. McCoy, Bowling Green, Ky.

[73] Assignee: Desa International, Inc., Bowling Green, Ky.

[21] Appl. No.: 347,560

[22] Filed: Nov. 30, 1994

[51] Int. Cl.[6] ..... F23Q 23/00

[52] U.S. Cl. ..... 431/24; 431/74; 431/72

[58] Field of Search ..... 431/24, 44–46, 431/71–74

[56] References Cited

U.S. PATENT DOCUMENTS 3,741,709 6/1973 Clark .

5,074,780 12/1991 Erdman ..... 431/24

OTHER PUBLICATIONS

Owner's Manual with illustrated parts list for non–microprocessor Models R55 and R150B. Sales brochures for Applicant's non–microprocessor oil heaters, 1993 and 1994.

*Primary Examiner*—Carroll B. Dority

*Attorney, Agent, or Firm*—Jones, Day, Reavis & Pogue

[57] ABSTRACT

A primary control unit and ignitor using a microprocessor for fuel and ignition control and intelligent flame monitoring of a fuel burning device such as kerosene fired heaters. The control unit will function with a voltage supply ranging from 30 to 264 volts, 50 or 60 hertz. It has intermittent ignition resulting in reduced electromagnetic interference and longer spark plug life. The ignitor circuit is isolated from the DC power supply to prevent any common mode electromagnetic interference.

16 Claims, 5 Drawing Sheets

TO FIG. 3B

MICROPROCESSOR CONTROLLED FUEL AND IGNITION CONTROL FOR A FUEL BURNING DEVICE

BACKGROUND OF THE INVENTION

1. Field of the Invention

The present invention relates to the control of fuel burning devices in general and in particular relates to a primary control unit and ignitor using a microprocessor for fuel and ignition control and intelligent flame monitoring of a fuel burning device such as kerosene fired heaters.

2. Description of Related Art

While the control circuit of the present invention is generally applicable to fuel burning systems, for purposes of an exemplary illustration it will be described in connection with portable space heaters of conventional and well-known types frequently used, for example, by contractors for heating and drying purposes.

The nature of the fuel burning portable space heater does not constitute a limitation on the present invention. In general, such a space heater typically comprises an outer housing surrounding a combustion chamber. Air is introduced into the combustion chamber. A burner is located at one end of the combustion chamber. The burner normally has a fuel nozzle frequently incorporating eductor means providing jets of air to draw, mix, and atomize the fuel delivered by the nozzle. The nozzle, together with the eductors, discharge a combustible fuel-air mixture into the combustion chamber. An ignitor is provided to ignite the mixture and, after initial ignition, continuous burning occurs. Typically, during the continuous combustion, convection heat currents issue from the end of the heater opposite the burner and additional heat radiates from the surface of the heater housing.

Portable space heaters of the general type described are frequently provided with an ignition transformer and a motor. The motor normally runs a fan supplying air to the combustion chamber and the eductors and operates a fuel pump.

When the portable space heater is functioning properly, fuel burning will occur near the end of the combustion chamber at which the burner is located. In the event of improper air flow, however, the flame will move toward the opposite end of the combustion chamber, the combustion becoming unsteady and inadequate for proper heating. Under such a circumstance, it is desirable to shut down the heater. Inadequate air may result from a malfunction of the fan or a blocking of the passages for air into the combustion chamber.

Inadequate operation and possibly dangerous conditions may also be indicated by a lower than normal temperature of the burner flame, representing improper combustion conditions.

It is also desirable to shut down the portable space heater when there is a flame failure. This can occur by virtue of faulty ignition, a blockage of the fuel nozzle or exhaustion of the fuel supply.

In any case, the malfunction can cause insufficient or incomplete burning or a failure to burn issuing fuel, producing a dangerous existence of highly flammable liquid or noxious fumes. Prior art devices include a number of safety control circuits for fuel burning devices proposed to avoid the many and often disastrous results of improper burning or failure of flame in apparatus such as portable space heaters.

For example, circuits have been proposed incorporating a thermal sensitive circuit breaker, a heating coil to energize the circuit breaker and a cadmium sulfide cell to monitor the flames of the fuel burning device. The heating coil and the cell are connected in parallel, the cell being shunted across the heating coil. The theory was that so long as the cadmium sulfide cell sensed a proper flame, insufficient current would pass through the heating coil to trip the thermal sensitive circuit breaker. In such a circuit, however, the cadmium sulfide cell would sometimes react to flame flicker causing the tripping of the circuit breaker when shutdown of the fuel burning device was not actually required.

In another embodiment, a thermal sensitive circuit breaker and heating coil were again used together with a cadmium sulfide cell. In this embodiment, a relay was provided having normally closed contact points in series with the heating coil. When the cadmium sulfide cell sensed a proper flame, the armature of the relay would react so that the normally closed contact points would open removing sufficient power from the heating coil to prevent tripping of the circuit breaker. Such a circuit, however, has proven expensive to manufacture, requiring a relay which is a relatively large component and is subject to mechanical failure of the relay.

In still another prior art embodiment, the safety control circuit is a solid-state circuit making it easy to apply in the most convenient manner. The circuit is reactive both to improper burning and loss of flame, irrespective of the cause. The circuit is designed in the preferred embodiment such that it is not reactive to ordinary flame flicker so that unnecessary and sometimes damaging shutdown of the fuel burning device will not occur. The circuit contains no relay or similar devices of prior art apparatus which have often been subject to mechanical failure. The circuit is simple and contains a small number of elements and is characterized by quick response in the event of improper burning or flame loss.

The device provides the solid-state flame sensing control circuit with first and second leads capable of providing a connection to a power source. The electrical power means of the fuel burning device is connected across the first and second leads in parallel, such electrical power means comprising a motor and an ignition transformer. In the preferred embodiment, a thermal sensitive circuit breaker has the contacts thereof connected in one of the leads and across the first and second leads is connected an additional lead incorporating, in series, a heating coil for actuating the circuit breaker, a first resistor, and a silicon controlled rectifier. Yet another lead is provided incorporating a second resistor and a cadmium sulfide cell.

This last-mentioned lead is connected at one end to that lead containing the heating coil, first resistor, and silicon controlled rectifier at a position between the heating coil and the first resistor. The other end of the lead containing the second resistor and the cadmium sulfide cell is connected to the second lead. Finally, the gate of the silicon controlled rectifier is connected by a lead to that lead containing the second resistor and the cadmium sulfide cell at a position between the last two mentioned elements. The silicon controlled rectifier gate lead contains a breakover device.

When the cadmium sulfide cell senses a proper flame, sufficient voltage for firing the breakover device does not exist and the gate of the silicon controlled rectifier is not energized. Therefore, the silicon controlled rectifier will, under such conditions, be rendered nonconductive and the heating coil will then carry an insufficient amount of current to trip the thermal sensitive circuit breaker. Upon the occurrence of a flame failure or improper burning, the resistance of the cadmium sulfide cell will responsibly increase to produce the firing voltage of the breakover device. Once this occurs, the gate of the silicon controlled rectifier will be energized and the silicon controlled rectifier will be rendered conductive, thereby permitting a flow of current through the heating coil sufficient to cause it to trip the thermal sensitive circuit breaker. As provided, the breakover device ensures that the circuit will not react to normal flame flicker. This invention is disclosed in U.S. Pat. No. 3,741,709.

It would be advantageous to have a primary control and ignitor using a microprocessor for fuel and ignition control and intelligent flame monitoring of a fuel burning device such as kerosene fired heaters. Furthermore, with program changes of the microprocessor, the control unit can be used with gas heaters. The objective is to provide a fast shutdown of the heater if normal combustion does not occur or is lost after being established. It is important to make the heater as safe as possible and to eliminate odors associated with incomplete combustion during an out-of-fuel condition. It is also important to have an out-of-fuel condition indicator and a visual indicator of the operational sequences of the control unit including fault codes and a low fuel code using an LED display.

It would also be advantageous to provide longer ignitor life and prevent common mode interference between the power supplies of the microprocessor and the ignitor. It would further be helpful to have a unit that would have an international control which could operate from 30 to 260 volt operation and 50 or 60 cycle.

Finally, it would be helpful to provide a control module that would result in less assembly time and production costs.

SUMMARY OF THE INVENTION

The present invention uses a microprocessor for fuel and ignition control and intelligent flame monitoring of a fuel burning device such as kerosene fired heaters. Since the microprocessor uses a program, program changes will allow the control unit to be used with gas heaters. With the use of the microprocessor, a fast shutdown of the heater is obtained if normal combustion does not occur or is lost after being established. The present invention provides an out-of-fuel condition indicator and a visual indication of the operational sequences of the control unit including fault codes and a low fuel code through the use of an LED display. By providing intermittent ignition, the ignitor life is preserved or lengthened and, by providing phase isolation between the MCU and the ignitor, common mode interference between the ignitor and the power supplies of the microprocessor is eliminated. The present control unit operates on 30 to 264 volts, 50 or 60 cycles and the ignitor and control unit are combined into one module.

Thus, it is an object of the present invention to provide a primary control unit and ignitor that uses a microprocessor for fuel and ignition control and intelligent flame monitoring of a fuel burning device such as a kerosene fired heater.

It is another object of the present invention to provide a fast shutdown of the heater if normal combustion does not occur or is lost after being established.

It is also an object of the present invention to provide an out-of-fuel condition indicator.

It is still another object of the present invention to provide a visual indication of the operational sequences of the control unit including fault codes and low fuel codes by the use of an LED display.

It is still a further object of the present invention to provide intermittent ignition by the ignitor circuit.

It is yet another object of the present invention to provide phase isolation between the microprocessor and the ignitor to prevent common mode interference between the power supplies of the microprocessor and the ignitor.

It is still another object of the present invention to provide an international control unit that utilizes 30 to 264 volt, 50 or 60 cycle operation.

It is also an object of the present invention to combine the ignitor and control into one module that is located in the heater in a manner that would result in less assembly time and reduced production costs.

BRIEF DESCRIPTION OF THE DRAWINGS

These and other features of the present invention will be more fully disclosed in the following DETAILED DESCRIPTION OF THE DRAWINGS in which like numerals represent like elements and in which.

DETAILED DESCRIPTION OF THE DRAWINGS

Figures 1A, 1B:
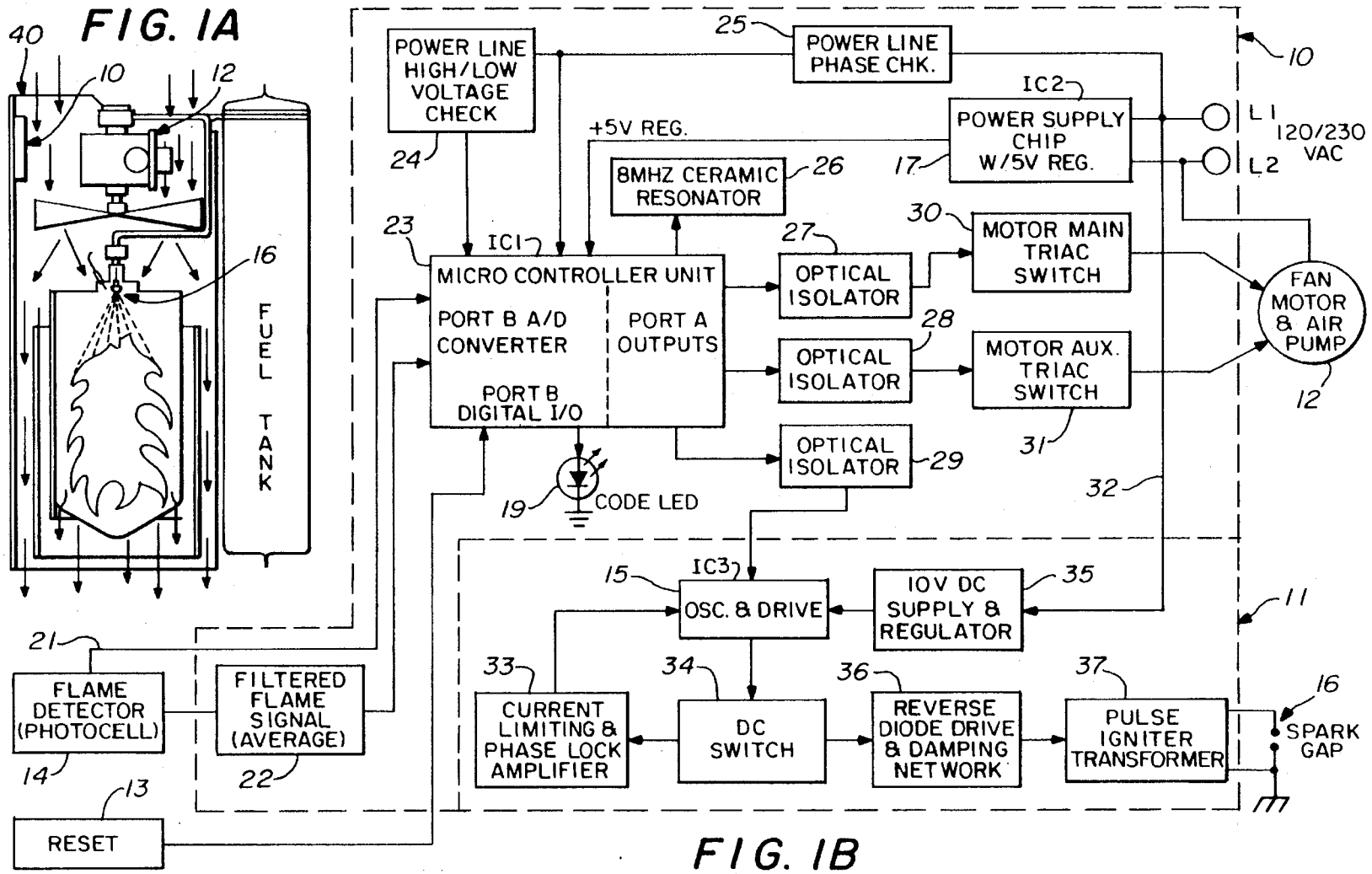
FIGS. 1A and 1B are block diagrams of the novel primary control unit and ignitor.

FIG. 1A is a schematic representation of a fuel burning device such as a kerosene fired heater enclosed in a cabinet 40, having a control unit 10 mounted preferably on a printed circuit board within the housing 40 and including a fan motor 12 and an ignitor 16 for igniting fuel emitted from a fuel jet as shown.

The details of the control unit 10 are shown in FIG. 1B. The control unit 10 controls the application of electrical power from the electrical power line having a phase L1 and a neutral L2. The electrical power is supplied through the control unit 10 to the fan and air pump motor 12 and the on-board ignitor 16. The power supplied by power lines L1 and L2 in FIG. 1B may be 120 volt or 230 volt AC, either 50 or 60 cycles. That power is coupled to the power supply 17, the output of which regulator 35 is a regulated 5 volts DC that is coupled to the micro control unit 23. Circuits 24 and 25 are coupled to the input power terminal L1 to provide a power line high and low voltage check and phase check. A flame detector 14, which may be a photocell, generates an output signal on line 21 to the microprocessor 23. The analog output signal from the flame detector 14 may also pass through a filter 22 and then be coupled to the microprocessor controller 23. A reset switch is provided at 13 and is also coupled to the microprocessor 23. The microprocessor 23 drives an LED indicator 19 to provide status indication codes.

Optical isolator 27 couples the microprocessor 23 to the motor auxiliary triac switch 30 that drives the motor main winding. Optical isolator 28 couples the microprocessor 23 to the main motor winding control triac switch 31.

Optical coupler 29 couples the control ignition from microprocessor 23 through IC3 (15) to cause ignition to occur.

IC3 drives a DC switch 34 to control the pulse ignitor transformer 37. The transformer 37 causes the ignition spark to occur at spark gap 16. A current limiting circuit 33 is also provided. An 8 Mhz ceramic resonator module 26 provides the high frequency drive for the on-board clock oscillator of the MCU 23. A reverse diode drive and clamping network couples the DC switch 34 output to the ignitor transformer 37.

Figure 2A:
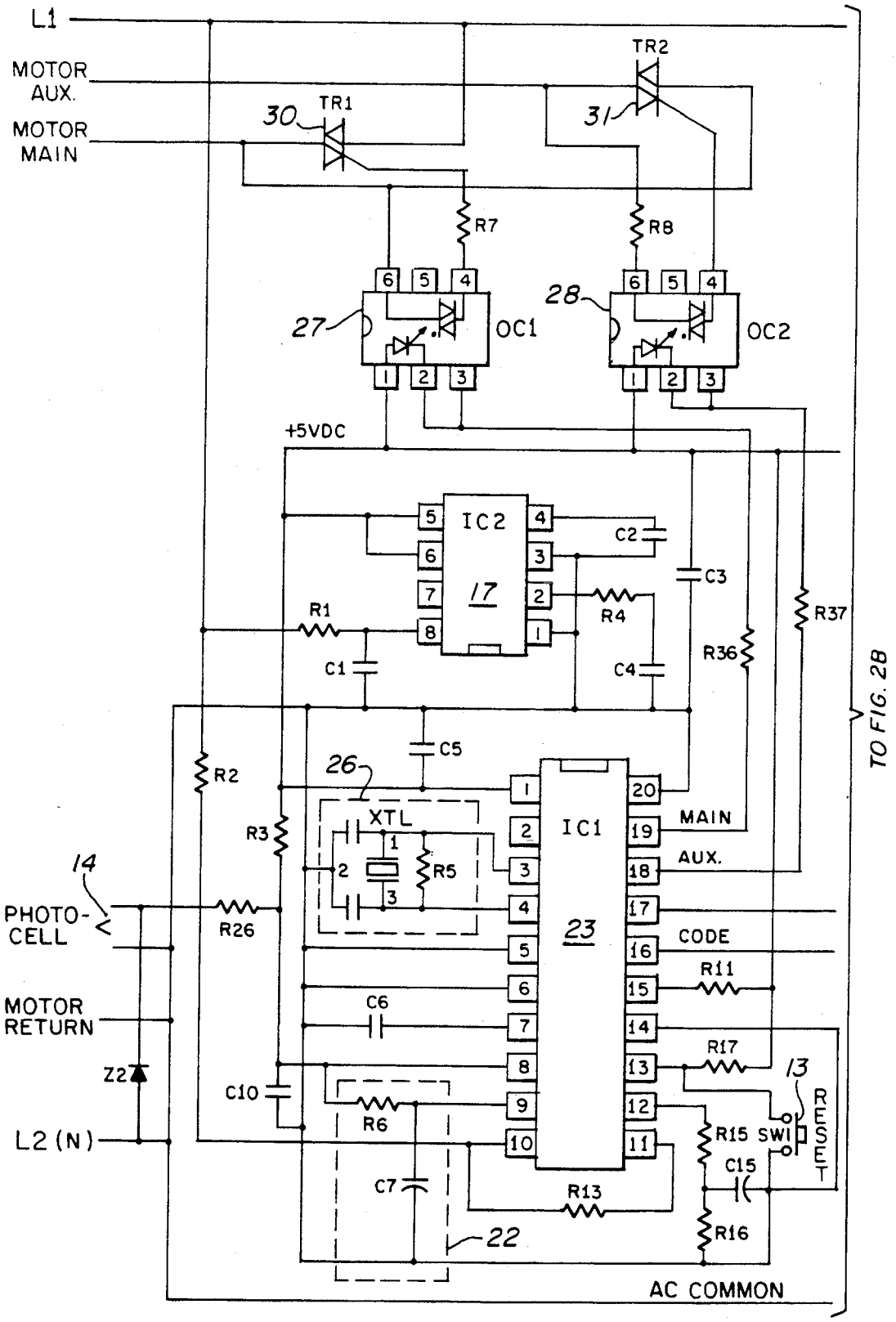
FIGS. 2A and 2B form a circuit diagram of the primary control unit and ignitor.
Figure 2B:
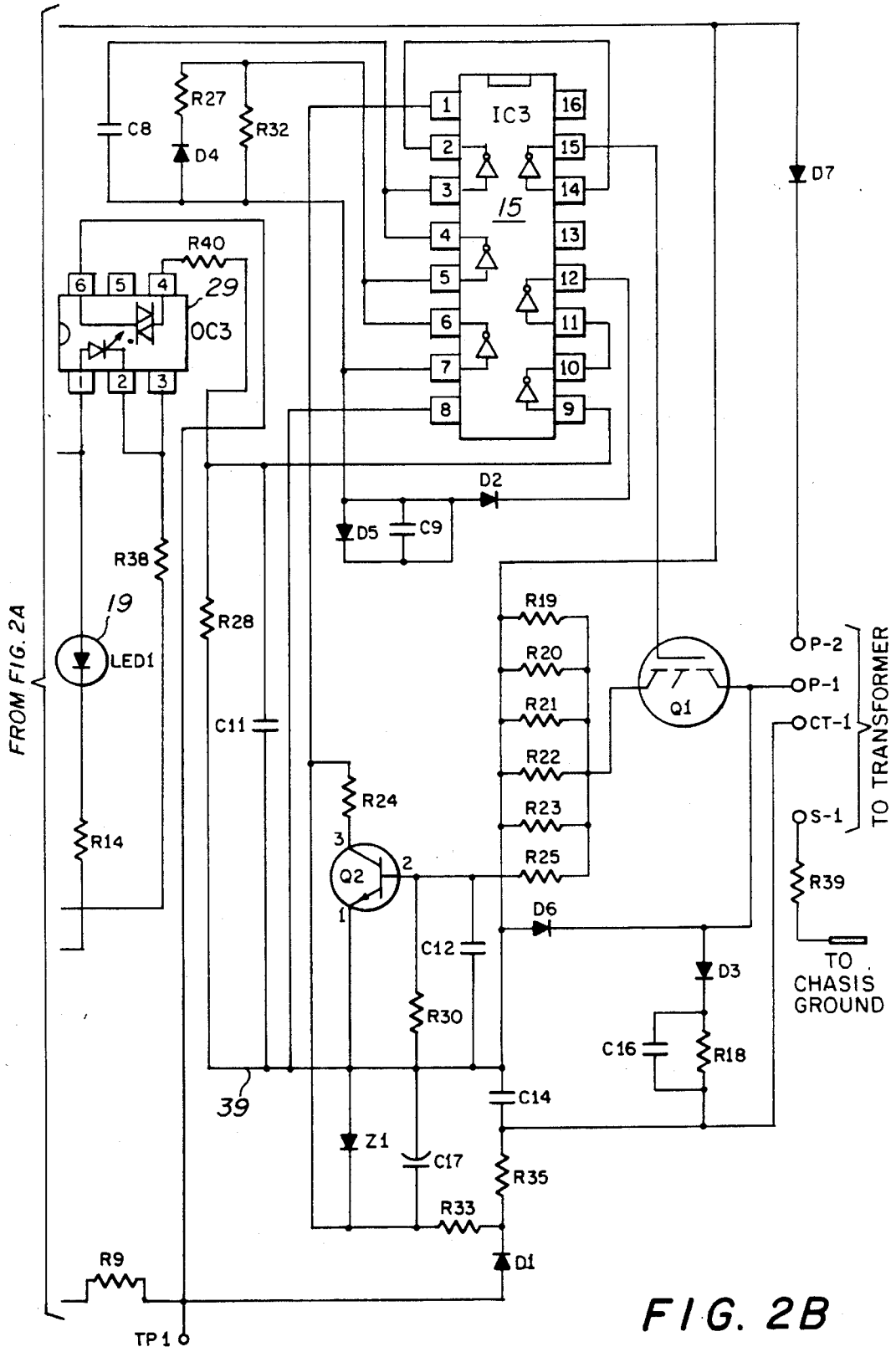

Turning now to FIG. 2A and FIG. 2B, there is shown a schematic diagram of the invention. The control 10 is powered by a regulated 5-volts DC that is supplied by integrated circuit chip 17 (IC2) which is a power supply chip that operates only on the positive half cycle of the AC power line. The onboard ignitor 16 is of the pulse-type ignitor and operates only during the negative-going half cycle of the power supply. The power supply chip 17 draws no current from the power line while the ignitor 16 is operating. Thus any common mode electromagnetic interference that is generated by the on-board ignitor 16 is prevented from interfering with the operation of the single-chip power supply 17 and the microprocessor 23. This feature is called "phase isolation". The AC line L1 is connected to the pin 8 of the power supply chip 17 through resistor R1. Capacitor C1 is for line electromagnetic interference bypass only. Capacitor C2 is used to improve the stability of the power supply chip 17. The regulated 5 volts from power supply 17 is supplied to the 5-volt bus by power supply 17 through pin 6. Capacitor C3 further filters the regulated 5 volts. Capacitor C5 provides an electromagnetic interference bypass. Chip 23 (IC1) is a microprocessor chip such as the ST6210 made by SGS Thompson. It has an on-board A/D converter, one 4-bit I/O, and one 8-bit I/O port, reset pin and on-board RAM and ROM. Ceramic resonator module 26 provides the high frequency drive for the on-board clock oscillator of the microprocessor 23. Resistor R5 provides the proper loading for the resonator module CR1. Resistor R2 provides a sample of the power line voltage for determining the zero crossing point of the power line by the microprocessor 23. Resistors R2 and R13 form a voltage divider when one end of R13 is switched to VSS by the microprocessor 23. This voltage divider is used to provide a voltage proportional to the power line voltage at the A/D input of the microprocessor 23 and is used to determine the maximum and minimum allowed operating voltage. The values of resistors R2 and R13 are selected to provide a voltage level at the A/D input of the microprocessor 23 that is between 0 and the +5 volt power supply and is within a pre-established window in this range at the precise time of the cross-over point of the 120 volts, 60 hertz voltage or the 230 volts, 50 hertz power line phases. This allows the same microprocessor program sequence to be used for both 120 volts, 60 hertz, and 230 volts, 50 hertz by measuring the minimum and maximum operating voltage ranges. Resistors R3, and R26 and the photocell 14 form a voltage divider that provides the unfiltered flame signal to an A/D input (pin 8) of the microprocessor 23. Resistor R6 and capacitor C7 form a filter 22 that removes the AC component from the flame signal leaving the average DC signal only and couples it to a separate A/D input (pin 9) of the microprocessor 23. Resistor 14 and LED 19 are connected in series between the 5-volt bus and an I/O of the microprocessor 23 and serves as a visual indicator for the various fault codes.

Triac 30 (TR1) is an electronic device that switches the main winding of the motor to phase L1 of the power line. Triac 31 (TR2) works the same as TR1 except that it connects L1 to the auxiliary winding of the motor. Optical isolators 27 (OC1), 28 (OC2), and 29 (OC3) have an LED input and a triac output with zero crossing switching. They provide gate drive to TR1 and TR2 and to IC3 (15), respectively. They also provide the voltage isolation necessary between the input line L1 and the microprocessor 23 to reduce electromagnetic interference as stated previously. The cathode of the LED in optical isolator 27 connects to an IO of the microprocessor through R36 and when the IO pin 19 is at logic high, no current flows through the LED optical isolator 27 (OC1) and triac TR1 is OFF. When the IO on pin 19 switches to logic low, current flows through R36 and the LED and the triac in the optical coupler 27 (OC1) turns ON and supplies drive to the gate of triac 30 (TR1) through R7, turning ON TR1, and switching the power supply ON to the motor main winding. The circuits for OC2 and OC3 operate in the same manner, but, provide drive to TR2 to provide power to the auxiliary winding and to IC3 (15) to control ignition.

R11 in FIG. 2A is connected to an A/D input of the microprocessor 23. Selecting different values of R11 selects different modes or programs in the microprocessor 23.

A manual reset switch 13 (normally open, momentary type switch) is connected from MCU 23, pin 13, to VSS and is used to restart the heater from a fault mode. Resistor R17 is a pull-up for the reset switch 13.

A reset delay circuit is connected to pin 12 of MCU 23 (IC1). MCU 23 at pin 12 charges capacitor C15 during trial ignition. The charge on C15 is sampled by MCU 23 at pin 12 and prevents a restart until resistor R16 discharges capacitor C15 below a predetermined level.

The circuit shown in FIG. 2B is a schematic diagram of an on-board ignitor of the pulse-type having an operation frequency in the range of 15 kHz to 50 kHz. It has current limiting, automatic frequency control, and low voltage lock-out. A low profile high voltage transformer T1 is specifically designed for this application and provides 8.5 kv RMS secondary voltage with sufficient current to ignite kerosene at low temperatures. The microprocessor output to optical isolator 29 (OC3) goes to logic 0, turning ON the LED in OC3. The triac in the isolator 29 turns ON at the next zero crossing of the power line voltage. If turn-ON occurs during the positive-going half cycle, the pulse ignitor will conduct on the next negative-going half cycle due to series diode D1, thus providing a half wave DC supply voltage for all of the ignitor circuits. The voltage magnitude is determined by the applied voltage. Connected to the cathode of D1 is a half wave 10-volt DC power supply that consists of resistor R33, capacitor C17, and zener diode Z1. Resistor R33 is a voltage-dropping power resistor that is in series with diode D1 and Z1. These components form a voltage divider across the power source, with 10 volts across the zener and a small power drop across D1. The rest is dropped across R33. Z1 prevents the voltage from going above 10 volts on the 10-volt bus.

Capacitor C8 from input pin 7 of the first inverter gate in logic circuit 15 (IC3) to output pin 4 of the second inverter stage of IC3, along with R32 from pin 7 to pin 6, forms an astable oscillator. Resistor R27 connects from diode D4 to the gate pin 7 of the oscillator and is used to decrease the duty cycle of the square wave pulse at pin 6 of the oscillator IC3. Three inverter buffer stages are used to couple the oscillator to the gate of IGBT power switching device Q1. These stages improve the rise and fall times of the square wave pulse train to the gate of Q1 to reduce switching time. A DC voltage proportional to the AC power line voltage is found at the junction of voltage divider resistors R40 and R28. This voltage is connected to pin 9 of one inverter of IC3. Capacitor C11 is an EMI bypass from pin 9 to bus 39. When the negative-going voltage of the power line rises to a predetermined level, the gate pin 9 passes the logic threshold and pin 10 goes to a logic low. The gate pin 11 also goes low causing pin 12 to go high. Diode D2 that had pin 7 clamped to VSS bus 39 is now biased OFF. Thus the oscillator starts to oscillate, supplying a pulse train through the three inverter stages to the gate of Q1. Note that when pin 7 of IC3 is low, then pin 1 of Q1 is also low, which turns OFF Q1. The oscillator continues to operate until a negative half cycle line voltage swings at pin 9 below the logic threshold. Pin 9 goes high, pin 12 goes high, and D2 again clamps pin 7 low and the oscillator stops, turning OFF the drive to Q1. When the base of Q1 is driven positive with respect to the emitter, Q1 is turned ON, completing the circuit from power line L1 to bus 39, through parallel resistors R19, R20, R21, R22, and R23, Q1, ignition transformer 37 (T1), resistor R35, and D1 to the power line neutral.

Current rises in the primary of transformer 37 (T1) causing a magnetic field to be created. The magnetic field passes through the turns of wire of the secondary of transformer 37 (T1) and induces voltage in the secondary. (The secondary current depends on the secondary load.) Current through C16 and R18 at this time is blocked by diode D3. When the gate of Q1 goes below approximately 4 volts, Q1 turns OFF. The magnetic field of the primary and secondary suddenly collapses, producing a voltage of opposite polarity between terminates P1 and S1 of ignition transformer (T1). This reverse polarity voltage causes a current to flow through C16 and R18 through D3 and through the primary of T1, thus producing a secondary voltage of opposite polarity. The values of C16 and R18 are chosen to produce a negative voltage close to the value of the positive voltage.

Capacitor C14 is a bypass type to prevent electromagnetic interference from the circuit coupling back into the power line. When Q1 is turned ON as described before, a voltage drop appears across the parallel resistors R19 through R23 that is proportional to the current through the circuit. This produces a positive-going pulse train that is fed back through resistor R25 to the base of Q2. Capacitor C12 and resistor R30 provide a time delay and smoothing of the feedback pulse train. The pulse train is amplified by Q2 and the AC component of the feedback signal is coupled through C9 to the gate pin 7 of the oscillator stage. Resistor R30 determines the gain and the DC bias of Q2. R24 is the pull-up resistor for Q2. A positive-going pulse at the emitter of Q1 of sufficient amplitude causes Q2 to conduct and the collector voltage of Q2 will start to drop from the VDD level toward VSS. This drop in voltage is coupled through capacitor C9 and causes the voltage level at pin 7 of the oscillator to drop. If the pulse at the base of Q2 continues to increase, the voltage at pin 7 of the oscillation will decrease below the logic threshold. This results in turning OFF the drive to Q1, which results in less positive pulses being coupled to the base of Q2 and these pulses are also amplified and coupled to pin 7 of the oscillator which influences the speed of the oscillator. A strong feedback pulse train will take control of the oscillator frequency.

Although the microprocessor control for portable kerosene heaters can be programmed to control other AC powered devices such as different types of heating products, by using a different source code or adding to this source code as an option, only the portable kerosene application will be discussed here.

The control is a microprocessor based unit that controls two triac power switching devices, one of which (30) controls power to an on-board pulse ignitor. A photosensitive visible light detector, such as a photocell 14 or phototransistor coupled to a fiberoptic link, is used to sense the presence or absence and the various intensities and sudden changes of the burner flame. The microprocessor has on-board 8-bit analog-to-digital converter. An LED 19 shown in FIG. 2A is used as both a pilot lamp and a code indicator. The unit has a visual indication (LED) for fault codes that are related to the cause of shutdown of the heater such as:

Code 0=fast blink—wait for reset

Code 1=not used

Code 2=not used

Code 3=low AC power line voltage

Code 4=high AC power line voltage

Code 5=high photocell resistance

Code 6=low photocell resistance

Code 7=combustion out of tolerance

Figure 3A:
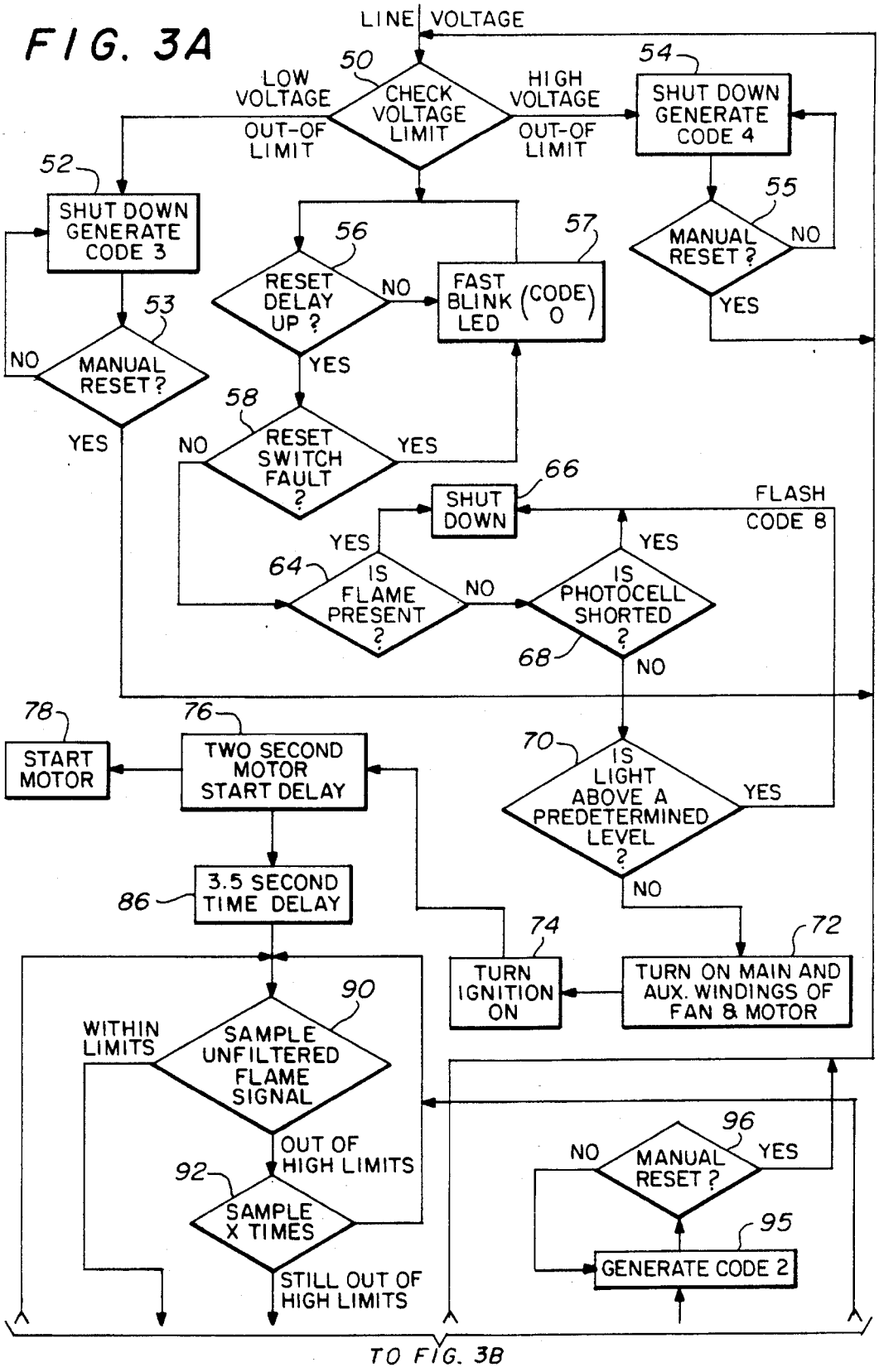
FIGS. 3A and 3B are flow charts describing the operation of the system in terms of process steps.

Consider now the flow charts in FIGS. 3A and. 3B. When the line voltage is applied to the heating device, the microprocessor, at step 50, samples the power line voltage applied to determine if it is within the minimum and maximum limits for both 120 volts, 60 hertz or 230 volts, 50 hertz operation. If the applied voltage is out of low limits, at step 52, the heater is shut down and code 3 is generated indicating out of low voltage limits. If a manual reset is to be generated at step 53, the reset button is depressed and line voltage is checked again. If not, the unit stays shut down with code 3 generated. If the voltage is out of limits for high voltage, at step 54, the heater is shut down and code 4 is generated. If a manual reset is to be generated at step 55, the reset button is depressed and line voltage is checked again. If not, the unit stays shut down with code 4 generated. If the applied voltage is within limits at step 56, a decision will be made to see if the reset delay time is up. If NO, then at step 57, code 0 will be generated. If YES, at step 58, a decision will be made to see if there is a reset switch fault. If YES, at step 57, code 0 will again be generated. If NO, the microprocessor will sample the unfiltered photocell signal to determine if a flame is present at step 64. If a flame is detected, the unit is shut down at step 66. If no flame or light is detected, a check is made at step 68 to see if the photocell is shorted. If it is, the unit is again shut down at step 66. If the photocell is not shorted, at step 70 the light level at start-up is checked and if it is below the maximum level, the microprocessor control unit turns on the main and auxiliary windings of the fan and air pump 12 at step 72. If the light is above a predetermined level, code is 6 is flashed and the unit is shut down. At step 74, the ignitor is turned ON, and the LED 19 is turned ON. This is the start of the ignition trial period. A two-second motor start delay is run at step 76 and at step 78 the fan motor is started.

Figure 3B:
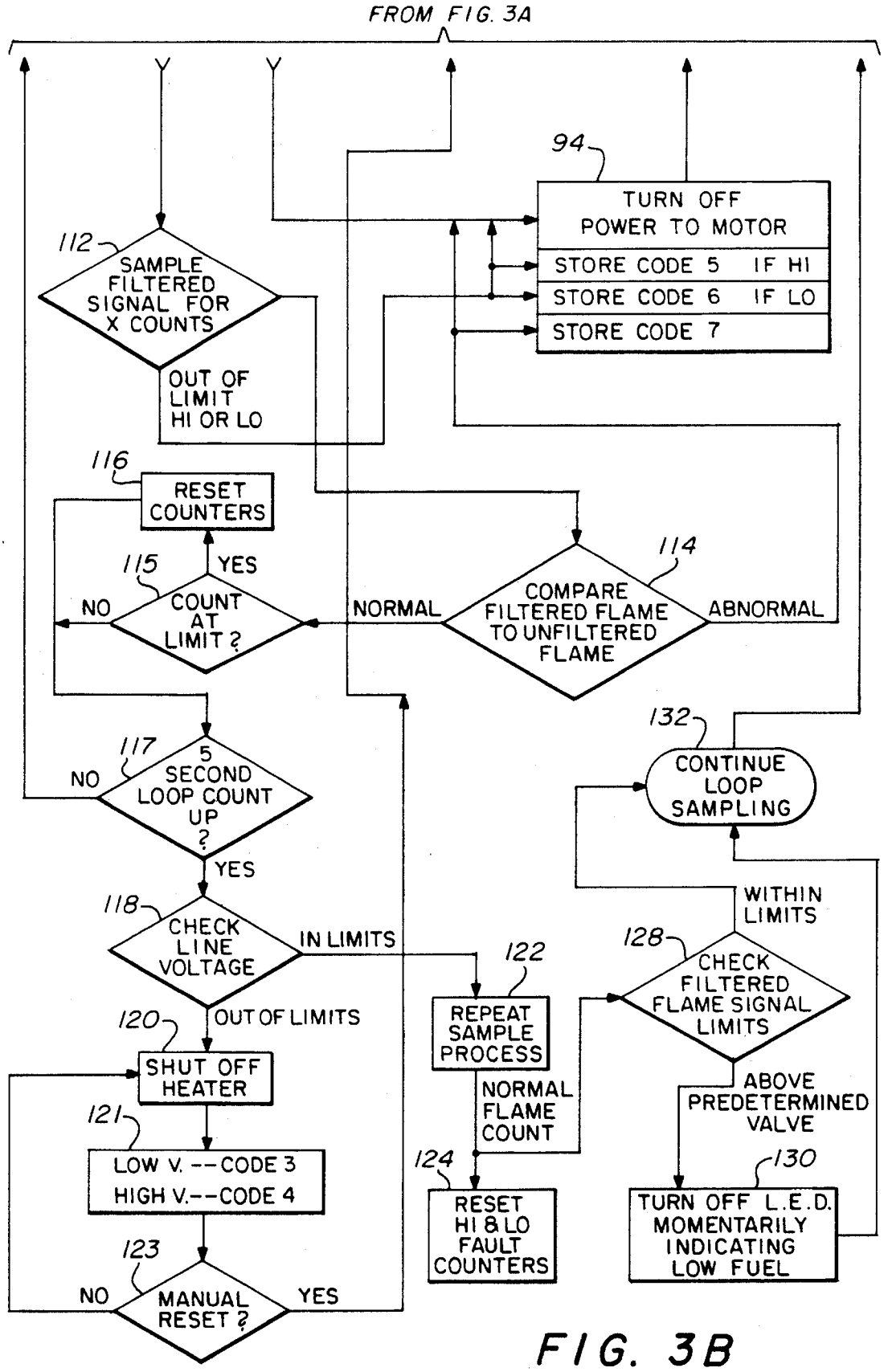

The ignition trial period ends after the additional time delay of three and one-half seconds at step 86. At this point, the RAM of the microprocessor is programmed for sampling the flame signals at step 90 in FIG. 3B and samples the unfiltered flame signal. The unfiltered flame signal result is evaluated for high limit only. If the unfiltered flame signal at step 90 is above the high limit, the sample process is repeated a predetermined number of times at step 92 (may be less than one second) and, if consistently out of limit, the power to the motor is turned OFF at step 94 and code 2 is generated at step 95. A manual reset may occur at step 96 if desired.

If the unfiltered flame signal is within limits at step 90, or becomes within limits before the sample period at step 92 has lapsed, a low and a high limit evaluation of the filtered flame signal is done at step 112. If the signal is out of limit, code 5 or code 6 is stored and the motor is then turned OFF at step 94.

If no out-of-limit condition is found at step 112, the microprocessor adds one count to the flame count and moves on to the flame delta routine at step 114. The flame delta routine at step 114 compares the filtered flame signal to the unfiltered flame signal and evaluates the differences. A normal deviation of the unfiltered signal both positive and negative going when compared to the filtered signal is considered to be a normal flame signal. A repeated abnormal lower level signal than normal or a greater than normal minus deviation of the unfiltered signal from the filtered signal results in turning OFF the heater at step 94 and flashing the corresponding fault code 7. A series of stronger than normal negative-going readings is associated with a combustion out of tolerance.

If the delta signal is normal at step 114, the delta memory count is checked at step 115 and, if at its limit, is reset at step 116. The line voltage is checked for tolerance every five seconds. If the 5-second delta loop count at step 117 is not up, the process returns to step 90. If the count is equal to five seconds, the AC line voltage is again sampled at step 118. If the line voltage measures out of limits, the heater is shut down at step 120 and code 3 or code 4 is generated at step 121. A manual reset may occur at step 123 if desired. If the line voltage is within limits at step 118, the microprocessor repeats the sampling process at step 122. When a series of normal flame counts have occurred, the high and low fault counts are reset at step 124 and a check of the filtered signal memory is made at step 128 and if it is above the predetermined value, LED 19 will be turned OFF momentarily at step 130 to visually indicate a low fuel condition. If the filtered flame signal is within limits, and if the low fuel LED is lit, the sampling loop is continued at step 132 which goes back to step 98 to continue sampling the flame signal.

Thus, there has been disclosed a novel primary control and ignitor that uses a microprocessor for fuel and ignition control and intelligent flame monitoring of a fuel burning device such as kerosene fired heaters. With program changes of the microprocessor, the control unit can be used with gas heaters also. The novel control unit provides a fast shutdown of the heater if normal combustion does not occur or is lost after being established. The heater control eliminates odors associated with incomplete combustion during the out of fuel condition and provides safety factors for control of the heater. It provides and out-of-fuel condition indicator, a visual indication of the operational sequences of the control, including fault codes and low fuel code by the use of an LED display. It utilizes intermittent ignition and phase isolation to prevent common mode interference between the power supplies of the microprocessor and the ignitor. It also allows for an international control unit since it can be used with 30 to 360 volts operation both 50 and 60 hertz. The ignitor and control unit is combined into one module and is located in the heater in a manner that results in less assembly time and reduced production costs.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A microprocessor fuel and ignition control unit for a fuel burning device comprising:

an AC voltage source providing a positive one-half cycle and a negative one-half cycle;

a DC power supply coupled to said microprocessor and to said AC voltage source for operating only on the positive one-half cycle of the AC voltage to produce a regulated DC voltage for said control unit; and an ignitor circuit coupled to said microprocessor and said AC voltage source for using only the negative one-half cycle of said AC voltage to cause an ignition of said fuel so as to prevent any common mode electromagnetic interference generated by the ignitor from interfering with said DC power supply.

2. A control unit as in claim 1 further including a circuit coupled to said microprocessor for providing an input for establishing a minimum and a maximum allowed AC operating voltage range.

3. A control unit as in claim 2 wherein said circuit for establishing a minimum and a maximum operating voltage range for said AC voltage further comprises:

first and second series connected resistors for providing a voltage proportional to said AC voltage coupled to said microprocessor;

first circuit means in said microprocessor for determining the zero cross-over between said positive one-half cycle and said negative one-half cycle of said AC voltage;

a high and low limit AC operating voltage range stored in said microprocessor; and second circuit means in said microprocessor for comparing said proportional voltage to said operating voltage range in an established time period occurring at the time of said zero cross-over so as to shut down the fuel burning device if said AC voltage exceeds the said maximum or minimum range and to allow the same microprocessor program sequence to be used for both 120 volts, 60 hertz and 230 volts, 50 hertz.

4. A control unit as in claim 3 further including:

an AC voltage isolation network between said microprocessor and said ignitor for coupling said AC voltage to said ignitor; and said microprocessor controlling said isolation network to allow said AC voltage to be coupled to said ignitor to ignite said fuel and generate heated air while electrically isolating said ignitor AC voltage from said microprocessor.

5. A control unit as in claim 4 further comprising:

a device for sensing a flame after ignition of said fuel and generating an analog signal representative of the actual light level of said flame; and a flame sensing circuit in said microprocessor for shutting down said fuel burning device if no flame is sensed.

6. A control unit as in claim 5 further comprising:

a photocell as said device for sensing said flame;

a circuit in said microprocessor for checking said photocell to see if a short circuit exists; and said microprocessor shutting down said fuel burning device if a photocell short circuit exists.

7. A control unit as in claim 5 further comprising:

first circuit means in said microprocessor for establishing an acceptable light level from said photocell; and a comparator circuit in said microprocessor for comparing said acceptable light level with said analog signal representative of said actual light level and shutting down said fuel burning device if said actual light level exceeds a predetermined level.

8. A control unit as in claim 7 further comprising:

a fan motor for driving a fan to blow heated air; energizing means coupled to said fan motor and said comparator circuit for energizing said fan motor and said ignition if said actual light level is below said predetermined level; and a start delay circuit interposed between said energizer and said motor to delay starting said motor for a predetermined period of time.

9. A control unit as in claim 8 further comprising:

first circuit means for establishing a high limit of said photocell generated analog voltage output signal;

a sampling circuit coupled to said first circuit means and said photocell for sampling said photocell generated analog voltage a predetermined number of times and generating a first output signal if said generated analog voltage exceeds said high limit and generating a second output signal if said analog voltage does not exceed said high limit; and a fan motor turn-OFF circuit coupled to said sampling circuit for turning OFF said fan motor if said photocell generated analog voltage is greater than said high limit.

10. A control unit as in claim 9 further comprising:

a filter coupled to said photocell analog voltage output signal for providing a filtered output signal;

second circuit means for establishing a high and a low limit of said filtered photocell output signal;

a second sample circuit coupled to said filter and said second circuit means for sampling said filtered output signal a predetermined number of times and generating a first output if said filtered output signal is within said high or low limits and a second output signal if said filtered output signal is out of limits; and said microprocessor removing power to said fan motor if said second output signal is generated.

11. A control unit as in claim 10 further including:

a comparator enabled by said second sampling circuit and comparing said filtered flame signal to said unfiltered flame signal;

said comparator generating a first output signal resetting all counters if said comparison is normal; and said comparator generating a second output signal for said microprocessor to remove power from said fan motor if said comparison is abnormal.

12. A control unit as in claim 11 wherein said microprocessor constantly checks said AC voltage high and low limits during operation and shuts OFF the fuel burning device if said AC voltage is out of limits.

13. A control unit as in claim 11 wherein said microprocessor constantly repeats said sampling of said filtered and unfiltered photocell generated analog voltage signals.

14. A control unit as in claim 1 wherein said ignitor provides intermittent operation.

15. A control unit as in claim 1 wherein said ignitor is formed with said control unit into a single module for mounting in said fuel burning device.

16. A control unit as in claim 15 wherein said fuel burning device is a kerosene heater.

* * * * *